United States Patent [19]

Linnekin

[11] Patent Number: 4,553,756

[45] Date of Patent: Nov. 19, 1985

[54] CIRCULAR CHESS

[76] Inventor: Robert L. Linnekin, 82 Liberty St., Danvers, Mass. 01923

[21] Appl. No.: 523,171

[22] Filed: Aug. 12, 1983

[51] Int. Cl.[4] ..... A63F 3/02

[52] U.S. Cl. ..... 273/261

[58] Field of Search ..... 273/261, 258, 260

[56] References Cited

U.S. PATENT DOCUMENTS

| | | | |
|---|---|---|---|
| 872,923 | 12/1907 | Ford | 273/261 |
| 3,610,626 | 10/1971 | Nolte | 273/261 |
| 3,776,554 | 12/1973 | Capablanca et al. | 273/261 |
| 3,909,000 | 9/1975 | Akers | 273/239 X |
| 3,917,273 | 11/1975 | Blakewood, III | 273/261 |
| 4,211,420 | 7/1980 | Quiroz | 273/260 |

FOREIGN PATENT DOCUMENTS

| | | | |
|---|---|---|---|
| 2547851 | 4/1977 | Fed. Rep. of Germany | 273/238 |
| 209 | of 1893 | United Kingdom | 273/258 |
| 2055589 | 3/1981 | United Kingdom | 273/261 |
| 2113557 | 8/1983 | United Kingdom | 273/258 |

*Primary Examiner*—Richard C. Pinkham
*Assistant Examiner*—Scott L. Brown
*Attorney, Agent, or Firm*—Harvey B. Jacobson

[57] ABSTRACT

A circular game area is defined on a substantially planar game surface and includes fourteen generally straight, elongated radial zones spaced about and extending outward from a central zone. Each of the radial zones includes eight discrete spaces of two alternating colors spaced therealong and each set of corresponding spaces of the zones are disposed in an annular path extending about the central zone and the colors of each set of annular path spaces alternate thereabout. The fourteen zones include a pair of home zones arranged diametrically opposite each other on opposite sides of the central zone and with six of the radial zones disposed between the home zones in each direction extending about the central zone.

5 Claims, 3 Drawing Figures

CIRCULAR CHESS

BACKGROUND OF THE INVENTION

Various different forms of chess heretofore have been provided including both two and three dimensional chess and also including chess which is played on a circular playing area. However, most of these previously known forms of chess do not offer more than one or two variations of chess play from conventional chess play and do not enable attack by a single player piece upon another opposing player piece from opposite directions. Accordingly, a need exists for a more comprehensive form of chess which may be played to the satisfaction of more serious and skilled chess players having a desire for variations.

Examples of various different forms of circular chess games including some of the general structural and operational features of the instant invention are disclosed in U.S. Pat. Nos. 3,776,554, 3,851,883, 3,917,273, 3,918,715 and 4,322,085.

BRIEF DESCRIPTION OF THE INVENTION

The circular chess game of the instant invention utilizes a circular playing area including fourteen generally straight, elongated and radially extending zones spaced about and extending outward from a central zone. Each of the radial zones includes eight discrete spaces of two alternating colors spaced therealong and each set of corresponding spaces of the zones are disposed in an annular path extending about the central zone. The colors of each set of annular path spaces alternate thereabout. The fourteen zones includes a pair of home zones arranged diametrically opposite each other on opposite sides of the central zone and with six of the radial zones disposed between the home zones in each direction about the central zone. In this manner, each of the major chess pieces may be disposed on the corresponding spaces of a selected home zone and either a single or double set of pawns may be used and placed on the zone or zones adjacent the home zone. If only a single set of pawns is used, the Rook pieces may be limited to movement only toward the other opposing home space past the associated pawns until such time as the Rook pieces have moved laterally from their initial annular paths extending about the central zone. This, of course, would prevent first moves of the Rook pieces in reverse to capture the corresponding opposing rook piece. Further, a similar limitation could be placed upon the Queen pieces.

The main object of this invention is to provide a novel form of circular chess which may be played with a conventional set of chess pieces including only one set of pawns or which may also be played with a modified set of chess pieces including a double set of pawns.

Still another object of this invention is to provide a form of circular chess which will require considerably more expertise and concentration by an accomplished chess player.

Yet another object of this invention is to provide a form of chess which offers a considerable variation from the conventional form of chess.

A final object of this invention to be specifically enumerated herein is to provide an improved chess game in accordance with the preceding objects and which will conform to conventional forms of manufacture, be of simple construction and interesting to use so as to provide a device that will be economically feasible, long lasting and a welcome variation to accomplished chess players.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
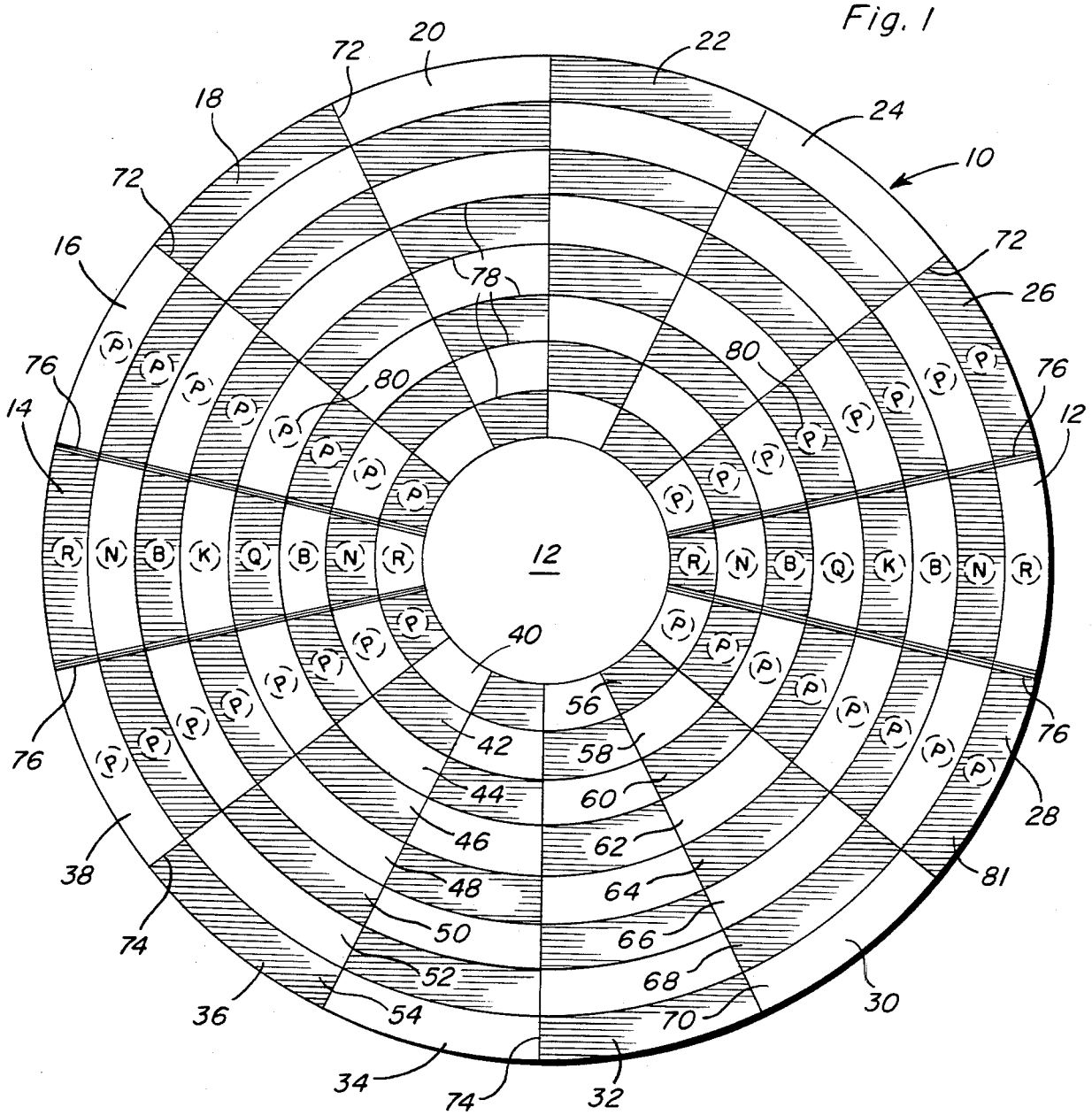
FIG. 1 is a plan view of the circular chess playing area of the instant invention and illustrating the manner in which not only a conventional set of chess pieces may be used but also the manner in which a modified set of chess pieces incorporating a double number of pawns may be used.

Referring now more specifically to the drawings, the numeral 10 generally designates the gameboard of the instant invention. The gameboard 10 is substantially circular and defines a central circular zone 11 about which fourteen generally straight, elongated radial zones 12, 14, 16, 18, 20, 22, 24, 26, 28, 30, 32, 34, 36 and 38 are defined with each zone including eight discrete spaces 40, 42, 44, 46, 48, 50, 52 and 54. Each set of eight discrete spaces are of two alternating colors comprising white and black and each set of corresponding spaces of the zones 40–54 are disposed in annular paths 56, 58, 60, 62, 64, 66, 68 and 70 extending about and concentric with the central zone 11. The colors of the spaces 40–54 in each of the zones 56–70 alternate thereabout.

Adjacent zones 16–26 are separated by radial lines 72, adjacent zones 28–38 are separated by similar lines 74 and the home zones 12 and 14 are each separated from the adjacent zones by darker lines 76. In addition, the adjacent annular paths 40–54 are separated by lines 78. Accordingly, each of the spaces 40–54 is clearly defines relative to adjacent spaces.

From FIG. 1 of the drawings, it may be seen that the major chess pieces may be placed in the home zones 12 and 14 in the same manner in which they are placed along remote edges of a conventional square chess board. In addition, if only a single set of pawns 80 is to be used, the pawns 80 may be placed in either the zones 16 and 26 or the zones 28 and 38. However, if double sets of pawns are to be used, the pawns may be placed in the zones 16, 26, 28 and 38.

Figure 2:
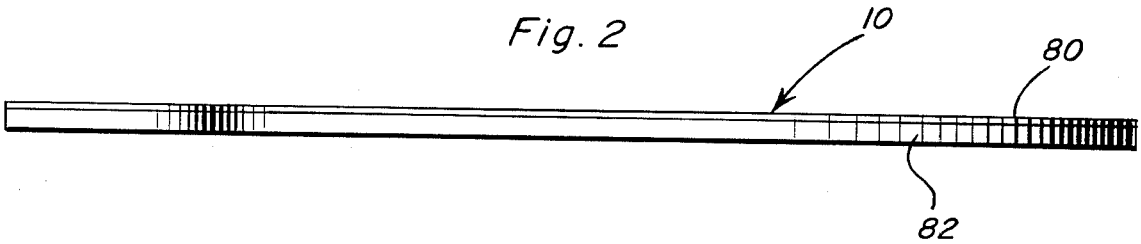
FIG. 2 is a side elevational view of the gameboard illustrated in FIG. 1.

With attention now invited more specifically to FIG. 2, it may be seen that the gameboard 10 comprises a circular game panel 81 mounted upon a suitable base 82. The game panel 81 may have the design of the playing area either printed, embossed or otherwise formed thereon.

Figure 3:
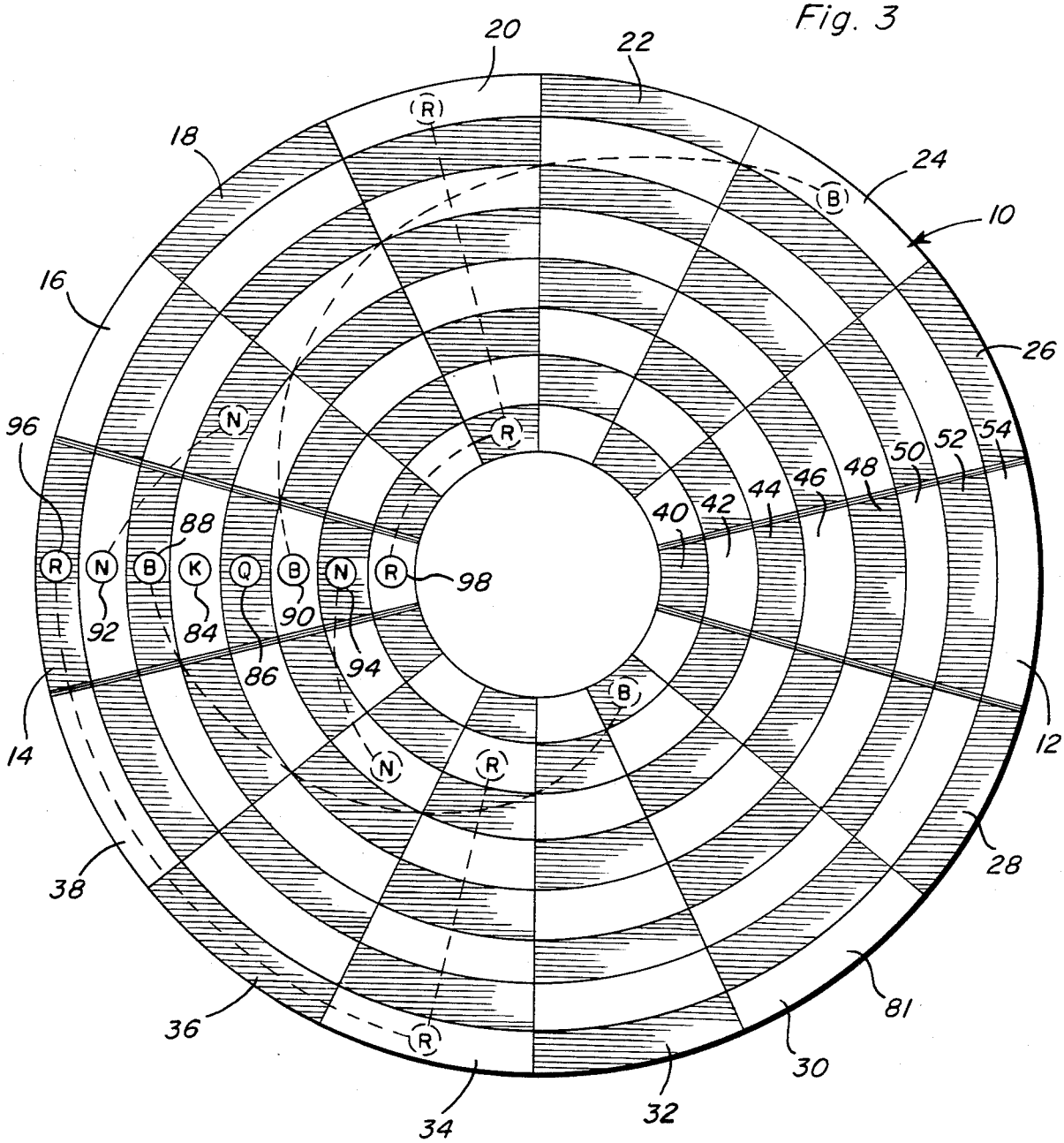
FIG. 3 is a further top plan view of the gameboard or area illustrating the manner in which the major chess pieces other than the pawns may move in opposite directions about the circular playing area during attack and defensive moves.

With attention now invited more specifically to FIG. 3, it may be seen that the major game pieces, the King 84, Queen 86, Bishops 88 and 90, Knights 92 and 94 and Rooks 96 and 98 may be initially positioned along the zone 14. The King 84 may, of course, move one space in any direction and the Bishops 88 and 90 may move in what would ordinarily be a diagonal path in either direction, but which paths on the gameboard 10 comprise either arcuate paths of increasing radius of curvature or arcuate paths of decreasing radius of curvature. In addition, the Knights 92 and 94 may move in the conventional manner including either two spaces forward and one space laterally or one space forward and two spaces laterally. Of course, the Knights 92 and 94 may also move in rearward directions and in lateral directions in the same manner. Further, the Rooks 96, 98 may move either in the zones 40–54 or the zones 14–38. Finally, the Queen 86 may, of course, move either as a Rook or Bishop.

Therefore, it may be noted that a game of chess played on the gameboard 10 may be quite challenging to even an experienced or accomplished player of conventional chess and may offer a pleasing alternative to conventional chess.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A flat, two-dimensional circular chess gameboard apparatus adapted for playing chess by two opposing players and to accommodate a plurality of standard chess pieces, said apparatus defining a circular game area including fourteen generally straight elongated radial zones spaced about and extending outward from a central zone, each of said radial zones including a single column of eight discrete spaces of two alternating colors spaced therealong and with each set of corresponding spaces of said zones disposed in an annular path extending about said central zone and with the colors of each set of annular path spaces alternating thereabout, said fourteen zones including a pair of home zones arranged diametrically opposite each other on opposite sides of said central zone and with six of said radial zones disposed between said home zones in each direction extending about said central zones, boundary line means defining a discrete generally straight boundary line extending generally radially of said central zone between each pair of adjacent radial zones with the boundary line between each side of each home zone and the adjacent radial zone being visually distinct from the boundary lines defined between adjacent radial zones exclusive of said home zones.

2. The assembly of claim 1 wherein alternating colors comprise the colors white and black.

3. The apparatus of claim 1 wherein said board is circular and said annular paths are concentric with the center of said circular board.

4. A flat two-dimensional circular chess gameboard apparatus adapted for playing chess by two opposing players and to accommodate a plurality of standard chess pieces, said apparatus defining a circular game area including fourteen, only, generally straight elongated radial zones spaced about and extending outward from a central zone, each of said radial zones including a single column of eight discrete spaces of two alternating colors spaced therealong and with each set of corresponding spaces of said zones disposed in an annular path extending about said central zone and with the colors of each set of annular path spaces alternating thereabout, said fourteen zones including a pair of home zones arranged diametrically opposite each other on opposite sides of said central zone and with six of said radial zones disposed between said home zones in each direction extending about said central zones, means defining a discrete generally straight boundary line extending generally radially of said central zone between each pair of adjacent radial zones with the boundary line between each side of each home zone and the adjacent radial zone being visually distinct from the boundary lines defined between adjacent radial zones exclusive of said home zones, said visually distinct lines between each home zone and the adjacent radial zone comprising wider boundary lines than the boundary lines between adjacent radial zones exclusive of said home zones.

5. The apparatus of claim 4 wherein alternating colors comprise the colors white and black.

* * * * *